US005816092A

United States Patent [19]

Pehle et al.

[11] Patent Number: 5,816,092

[45] Date of Patent: Oct. 6, 1998

[54] ROLL PASS DESIGN FOR A PIPE REDUCING ROLLING MILL

[75] Inventors: Hans-Joachim Pehle, Jüchen; Peter Thieven, Aachen, both of Germany

[73] Assignee: Mannesmann Aktiengesellschaft, Düsseldorf, Germany

[21] Appl. No.: 913,115

[22] PCT Filed: Feb. 2, 1996

[86] PCT No.: PCT/DE96/00205

§ 371 Date: Aug. 14, 1997

§ 102(e) Date: Aug. 14, 1997

[87] PCT Pub. No.: WO96/25249

PCT Pub. Date: Aug. 22, 1996

[30] Foreign Application Priority Data

Feb. 14, 1995 [DE] Germany ..... 195 06 858.0

[51] Int. Cl.[6] ..... B21B 13/10

[52] U.S. Cl. ..... 72/224; 72/235; 72/181

[58] Field of Search ..... 72/51, 52, 224, 72/182, 181, 178, 225, 234, 235, 367.1, 366.2; 228/146, 147, 145

[56] References Cited

U.S. PATENT DOCUMENTS

| | | | |
|---|---|---|---|
| 3,952,570 | 4/1976 | Demny et al. | 72/235 |
| 4,099,402 | 7/1978 | Biller | 72/234 |
| 4,277,967 | 7/1981 | Staat et al. | 72/224 |

FOREIGN PATENT DOCUMENTS

| | | | |
|---|---|---|---|
| 342403 | 11/1989 | Germany | 72/224 |

*Primary Examiner*—Joseph J. Hail, III
*Assistant Examiner*—Rodney Butler
*Attorney, Agent, or Firm*—Cohen, Pontani, Lieberman & Pavane

[57] ABSTRACT

A roll pass design for the sets of rolls of a non-mandrel type multiple-stand pipe reducing mill, each set of rolls having three rolls. In order to improve the roll pass design so that the flow of material in the pipe is acted upon locally in such a way that the occurrence of local thickening of the pipe wall at critical points along the circumference of the pipe during reduction is decreased, the magnitude of the curvature of the roll pass flanks of at least a plurality of sets of rolls succeeding one another in the rolling direction increases by constant amounts or by equal percentages.

4 Claims, 1 Drawing Sheet

ROLL PASS DESIGN FOR A PIPE REDUCING ROLLING MILL

BACKGROUND OF THE INVENTION

1. Field of the Invention

The invention is directed to a roll pass design for the sets of rolls of a non-mandrel type multiple-stand pipe reducing rolling mill. Each set of rolls has three rolls, in which the concave groove contours of the rolls are curved out in a convex manner at both sides of every roll.

2. Description of the Prior Art

In pipe reducing rolling mills, especially stretch-reducing mills which operate without an internal die, a phenomenon referred to as corner formation or polygon formation occurs as a result of the rolling process. With this phenomenon, the inner diameter of the pipe has a shape which diverges from the circular cross section and which can be described as a rectangular cross-sectional shape with rounded edges when using two roll passes and as a hexagonal cross-sectional shape with rounded edges when using a three-roll pass.

Various suggestions have been made for preventing this so-called polygon formation in the interior of the pipe. However, in essence, these suggestions have yielded inadequate results or require heavy expenditure.

A meaningful suggestion for this problem is described in German Patent 24 48 158. Based on the realization that the extent of the inner polygon becomes less pronounced as the quantity of roll sets used in the pipe reducing mill increases, the known prior art suggests approximating the deformation ratios of a roll set formed of three rolls to the deformation ratios of a roll set formed of six rolls. For this purpose, the groove contours of the rolls are curved out at the sides of the rolls.

The suggestion made in the prior art known from DE 24 48 158 does not take into account the fact that the proposed roll pass shape is not suitable by itself to render the deformation state homogeneous. Accordingly, the known solution incorrectly predicts the effect of the roll pass shape on the material flow. Disadvantageous tension states are brought about in the pipe during rolling and result in thickened locations in the finished pipe along the circumference of the pipe.

SUMMARY OF THE INVENTION

Proceeding from German Patent 24 48 158 and based on the roll pass shape suggested therein, the object of the present invention is to improve the roll pass design for a pipe reducing mill so that the flow of material in the pipe is acted upon locally in such a way that the occurrence of local thickening of the pipe wall at critical points along the circumference of the pipe during reduction is decreased so as to prevent the thickened locations encountered on the finished pipe.

In order to meet this object, the invention proposes that the magnitude of the curvature of the roll pass flanks in the known groove contour design be increased by constant amounts or by equal percentages in the rolling direction of successive sets of rolls. This suggestion is based on the insight that the known curvature has no effect on the flow of material if the reduction in the roll pass flanks brought about by the curvature does not exceed the reduction occurring in the groove base or roll pass gap in each stand of a plurality of successive working stands. Consequently, the height of the curvature must be increased from one stand to the next in the series of passes. The inventive suggestion results in the advantage that the local curvature increases the local contact pressure in every stand so as to counteract a thickening of material in the center of the roll pass flank. If polygon formation occurs in the finished pipe, that is, if the present invention is not applied, the wall thickness will be enlarged in the finished pipe at this location compared with the rest of the pipe circumference. The steps suggested by the invention counteract this thickening.

According to an advantageous embodiment of the invention, the increase in curvature corresponds to 1 to 5% of the pipe wall thickness of the pipe to be rolled in the roll pass.

In a further embodiment of the invention, the summit or apex of the curvature of each roll pass flank is shifted by 30 to 35 degrees proceeding from the groove base in the direction of the roll gap with reference to the center of the roll pass of the set of rolls. This step prevents the flow of material from being directed substantially toward the roll pass gap by means of a curvature positioned in the center or toward the base of the groove which leads to unwanted local thickening of the wall. When the apex of the curvature is shifted in the direction of the roll pass gap according to the invention, that is, if the curvature is arranged asymmetrically in the roll pass flank, this troublesome effect is corrected.

In another feature of the invention, a continuous series of up to a maximum of 12 stands of the working stands following the preliminary stands are provided with curved out roll pass flanks. As a result of the steps of the present invention, particularly with respect to stretch-reduction of steel pipes; the formation of inner polygons is substantially eliminated in that the flow of material in the pipe is influenced in the required manner. As a result, pipes can be expected to have a homogeneous deformation state and are rolled substantially without inner polygons, that is, with uniform wall thickness along the circumference.

The present invention is shown in a highly simplified manner in the drawings and is explained in the following.

DETAILED DESCRIPTION OF THE PREFERRED EMBODIMENTS

Figure 1:
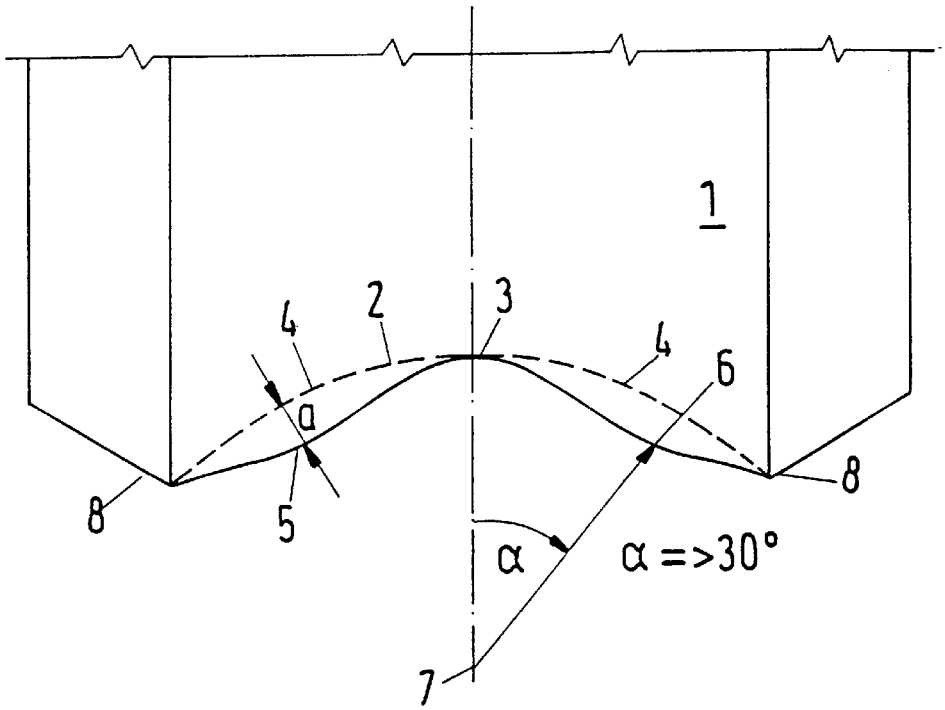
FIG. 1 shows the groove contour of one of the three rolls of a set of rolls.

In FIG. 1, the cut out portion of a roll, from a set of rolls comprising three rolls, is designated by 1, the basic groove 2 being concave or, in the present case, having a circular arc shape. In contrast to this basic groove 2, and based on the teaching of German Patent 24 48 158, the two flank regions 4 of the basic groove 2 located adjacent to the groove base 3 are curved out in a convex manner, the magnitude of the curvature 5 is indicated by a. The apex 6 of every curvature 5 is at an angle a with respect to the center 7 of the roll pass as measured from the groove base 3 in the direction of the roll gap 8, and amounts to 30 to 35 degrees.

Figure 2:
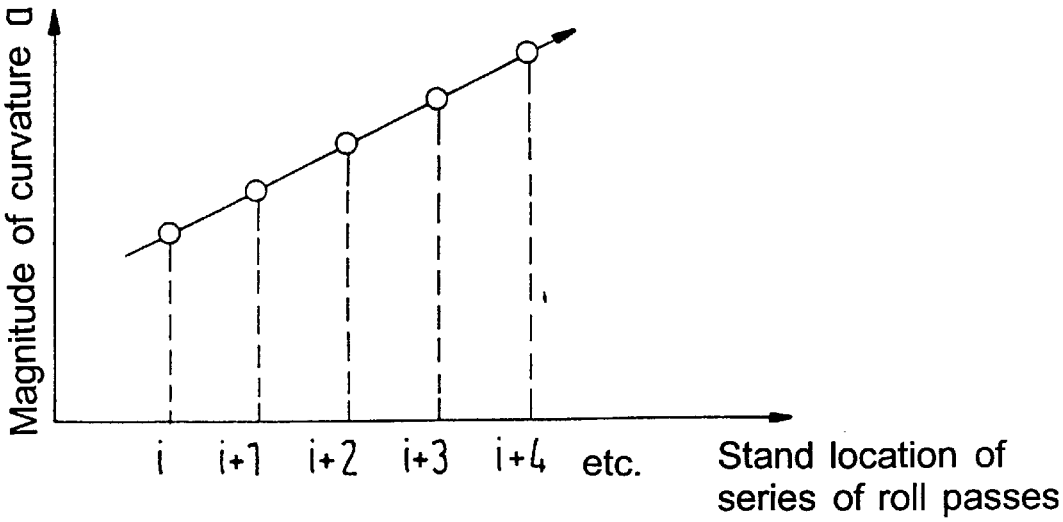
FIG. 2 is a graph showing the magnitude of the curvature over stand locations.

With reference to FIG. 2, the magnitude a of the curvature 5 proceeding from stand location i to the following adjacent stand locations i+1, i+2, i+3, i+4, etc. increases by a constant amount or by equal percentages. The stand locations of a quantity of working stands, of which a maximum of 12 are advantageously increased with respect to the magnitude of the curvature 5 according to the invention, are designated by i to i+n.

We claim:

1. A roll pass design for sets of rolls of a non-mandrel type multiple-stand pipe reducing mill, each set of rolls having three rolls, each of the rolls having concave groove contours that are curved out in a convex manner at both sides of the concave groove so as to form roll pass flanks with a curvature having a magnitude, the rolls being configured so that the magnitude of the curvature of the roll pass flanks of at least a plurality of sets of rolls succeeding one another in a rolling direction increases by one of constant amounts and equal percentages.

2. A roll pass design according to claim 1, wherein the increase in the curvature corresponds to 1 to 5% of a pipe wall thickness of a pipe to be rolled in the roll pass.

3. A roll pass design according to claim 1, wherein an apex of the curvature of each roll pass flank is shifted by 30 to 34 degrees proceeding from a base of the groove in a direction of a roll gap with reference to a center of the roll pass of the set of rolls.

4. A roll pass design according to claim 1, comprising preliminary stands and a continuous series of no more than twelve working stands following the preliminary stands and provided with curves in the roll pass flanks.

* * * * *